United States Patent [19]

Darner

[11] 4,340,157

[45] Jul. 20, 1982

[54] SELF-SEALING CLOSURE DISPENSER FOR PLASTIC STAIN BOTTLES

[75] Inventor: James C. Darner, Shrewsbury, Pa.

[73] Assignee: Becton, Dickinson & Company, Paramus, N.J.

[21] Appl. No.: 208,750

[22] Filed: Nov. 20, 1980

[51] Int. Cl.[3] ..... B65D 37/00

[52] U.S. Cl. ..... 222/211; 222/212; 222/148; 222/215

[58] Field of Search ..... 222/211, 212, 215, 148, 222/482; 239/327, 333; 128/278

[56] References Cited

U.S. PATENT DOCUMENTS

| | | | |
|---|---|---|---|
| 2,275,051 | 3/1942 | Maloney | 222/212 X |
| 2,690,278 | 9/1954 | Bacheller | 222/211 X |
| 2,853,210 | 9/1958 | Stewart et al. | 222/211 X |
| 2,879,924 | 3/1959 | Bacheller | 222/211 X |
| 3,162,333 | 12/1964 | Davidson | 222/211 X |
| 3,474,936 | 10/1969 | McDonnell | 222/272 X |
| 4,073,294 | 2/1978 | Stanley et al. | 128/278 |
| 4,122,979 | 10/1978 | Laauwe | 222/211 X |

*Primary Examiner*—Allen N. Knowles

[57] ABSTRACT

A dispenser mechanism is provided for capping squeeze-bottle type containers, wherein a dual valve arrangement provides for the dispensing of the contents of the container with automatic closure during periods of non-use. The contents of the container are not exposed to ambient until such time as it is dispensed. The dual valves respond to differences in pressure, and cooperate to dispense the contents of the container, or seal the openings thereof during non-use. The cap may include a dispenser spout which is cleaned of material at the end of the dispensing period by the action of the dispenser mechanism herein.

22 Claims, 2 Drawing Figures

SELF-SEALING CLOSURE DISPENSER FOR PLASTIC STAIN BOTTLES

BACKGROUND AND DESCRIPTION OF THE INVENTION

Generally speaking, this invention relates to a dispensing mechanism for containers, which mechanism also serves as a cap for the opening in the container. More particularly, this invention relates to a dispenser mechanism for squeeze-bottle type containers wherein a dual valve arrangement provides for dispensing of the contents of the container with an automatic closing function during periods of non-use. Thus, the material in the container is not exposed to ambient until such time as it is dispensed.

A valve opens under the action of pressure applied to the contents being expelled from the container as a result of the container being squeezed. During this operation, internal pressure overcomes the combined ambient pressure, and the pressure biasing the valve into closed position. Once the dispensing function has ceased, and pressure against the bottle or container wall is removed, pressure is reduced internally of the container and ambient pressure overcomes a second valve biased against the ambient pressure to cause air to flow through the dispensing path to remove any material left therein, and to force it back into the container. Simultaneously, this pressure overcomes the first dispensing valve to close it, and to seal against the valve seat. Subsequently, this return flow causes the pressure internally and externally of the container to equalize, and the second valves closes and seals off the container contents from ambient.

Thus, the dual valves of the invention herein respond to differences in pressure and cooperate to dispense the contents of the container, or to seal the contents thereof during non-use. The cap or closure of the invention may include a dispenser spout which is cleaned of material automatically at the end of the dispensing period by the differential pressure between ambient and internally of the container, causing the remainder of any dispensed material in the spout to be forced back into the container.

One of the important advantages to the arrangement of apparatus herein is its single-handed control of the materials being dispensed. That is, certain materials are hard to handle and control during dispensing, such as, for example, stains wherein it is important to dispense a certain quantity of stain, while promptly shutting the dispensing action without any further dripping or dispensing of small quantities from the dispenser opening. As will be appreciated, dripping stains can create certain problems if the material drops on other than the area where the material is being dispensed. Moreover, in certain applications, it is important that the environment where the material is being dispensed not be contaminated in any way by the application of the material being dispensed to an area other than the actual precise place where the material is to be applied.

Many prior art arrangements allow for a dispensing with a subsequent sealing action, but they require a two-handed arrangement wherein the closing action must be done by the operator's second hand from that which is actually causing the dispensing of the materials from the container. Or other arrangements simply require that each hand manipulate one of two parts to accomplish closing. Moreover, certain arrangements, while appropriate for dispensing materials, as required, cannot handle low viscosity solutions such as stain solutions, without leaking.

Certain other arrangements have been provided in the past wherein a dual valving system is utilized. One such arrangement is disclosed in U.S. Pat. No. 4,073,294. In that patent, a tandem arrangement of one-way spring-biased ball-check valves is disclosed. The arrangement is utilized to generated a vacuum in an attached container, and it operates to handle a gaseous substance rather than a powder or liquid. The arrangement is such that a vacuum is maintained when the system is at rest, as opposed to the arrangement herein where there is an equalization of pressure when the system is at rest.

STATEMENT OF THE INVENTION

By contrast, it has now been found in accordance with this invention, that a dispensing cap may be provided for a squeeze-bottle type container which can be operated single-handedly to dispense a hard-to-control type of material in a manner wherein only the desired amount of contents is dispensed with no dripping or leaking subsequent to the dispensing operation. Moreover, the dual valve arrangement herein operates to seal off the contents of the container when the dispensing action is completed, and to remove from the dispensing passage any left over materials therein. At rest, pressure is equalized on either side of the dispensing cap valves.

Once the dispensing function has ceased and there is an equalization of pressure internally and externally of the container, the contents thereof are effectively sealed until a further dispensing action is required. All of this may be handled single-handedly by someone using the dispenser arrangement herein, so that they may use their other hand to control or manipulate other objects being used during the dispensing function.

The invention herein is useful as a dispensing cap for containers of a variety of configurations and materials, as will be appreciated. The only limitation is that the walls of the container be flexible so as to allow for the "squeeze-bottle" action for the dispensing function.

As purely illustrative of materials which may be used for the dispensing cap or closure of the invention herein and for the containers involved, one may note that flexible thermoplastics are appropriate. Such thermoplastics include, for example, polyvinyl chloride, polyolefins such as, polyethylene and polypropylene, polyesters, and in some cases, polystyrene. As will be appreciated, these thermoplastics include modifiers to provide for the color, stability and flexibility required for the containers. Moreover, it is preferred that the cap or closure of the invention be comprised of such flexible materials so that they may be utilized in a press-fit type function for application to the containers involved if so desired. It will be appreciated, however, that helical screw-type grooves may be incorporated into the cap to cooperate with appropriate grooves in the neck of the opening of the container involved.

One of the features of the cap or closure of the invention here is its simplicity of construction. Because of this, the parts thereof may be easily molded of thermoplastic materials. However, if a metal construction is required for some reason, it may be perfected in relatively inexpensive procedures because of the simplicity of construction of the arrangement. As mentioned above, the materials utilized for forming the cap or closure of the invention will be determined largely by the material which is to be dispensed, and the container which is to be used, since it will be necessary to select a material which will not react with or be degraded by the materials being dispensed, as will be appreciated by practitioners in the art.

Accordingly, with the foregoing and other objects in view, this invention will now be more particularly described, and other objects and advantages hereof will be apparent from the following description, the accompanying drawings, and the appended claims.

DETAILED DESCRIPTION OF THE INVENTION

Figure 1:
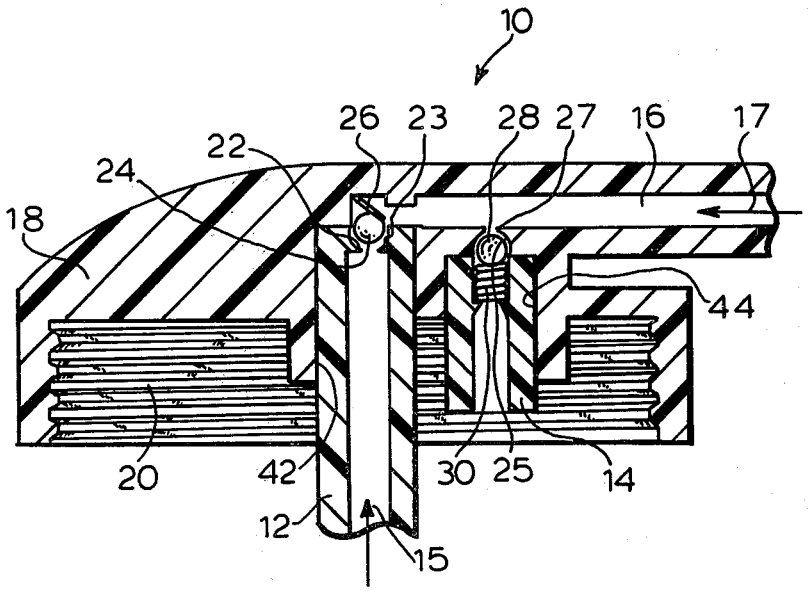
FIG. 1 is an enlarged cross-sectional view of one embodiment illustrating the cap or closure of the invention.

Referring to the drawings, in which like reference characters refer to like parts throughout the several views thereof, FIG. 1 shows a cap illustrating the invention designated generally 10 having a body 18 with a depending annular portion, preferably integral, incorporating helical grooves 20 for cooperating with opposed grooves on the neck of a container for applying the cap 10 to a container.

The upper portion of a feed tube 12 is shown inserted into a bore 42 in body 18 of cap 10. As will be appreciated, the tube 12 may be friction fitted into the bore 42, particularly if the material utilized for making the tube and the cap are a semi-flexible thermoplastic material. As will be appreciated, other approaches for maintaining the tube 12 in the bore 42 may be utilized, including the use of adhesives. Body 18 includes a delivery spout 16, preferably integral, which communicates with feed tube 12 through opening 22. Opening 22 is controlled by a positive displacement check valve 24 which cooperates with a semi-spherically-shaped seat 23 for closing opening 22. Valve 24 is ball-shaped in this embodiment, and includes a flexible hinge 26 for maintaining ball-shaped valve 24 against its seat 23.

A second tube 14 is shown inserted into a second bore 44 in body 18. This tube 14 is a return tube and communicates by an opening 27 with spout 16. Opening 27 is controlled by a negative displacement ball-shaped check valve 28 cooperating with a semi-spherical seat 25. A spring 30 urges valve 28 against its cooperating seat to control the opening 27.

In operation, if the container is squeezed, the squeezing action causes the pressure inside the container to increase forcing material in the container up through feed tube 12 in the direction of arrow 15. This increased pressure internally is such as to overcome the combined pressure of the weight of positive displacement check valve 24, flexible hinge 26 and ambient pressure in delivery spout 16. Thus, valve 24 opens and allows material to be dispensed through opening 22 and along delivery spout 16.

During this operation, of course, pressure against the negative displacement check valve 28 and spring 30 cooperate to maintain that valve against its seat 25 maintaining opening 27 closed. Subsequently, when pressure is released from the container walls, pressure is reduced internally of the container. This action causes the pressure externally to overcome the pressure internally, causing valve 24 to move against its seat closing off further dispensing of material through feed tube 12. Because ambient pressure is higher at this time than the internal pressure of the container, air moves in the direction of arrow 17 through delivery spout 16, overcoming the action of spring 30, and allowing negative displacement check valve 28 to open.

At this point, any materials left in delivery spout 16 are forced through opening 27, and a further movement of air through that valve serves to equalize the pressure internally and externally of the container. This causes the closing of negative displacement check valve 28, because of the combined internal pressure and pressure from spring 30 overcomes ambient pressure at this point.

Figure 2:
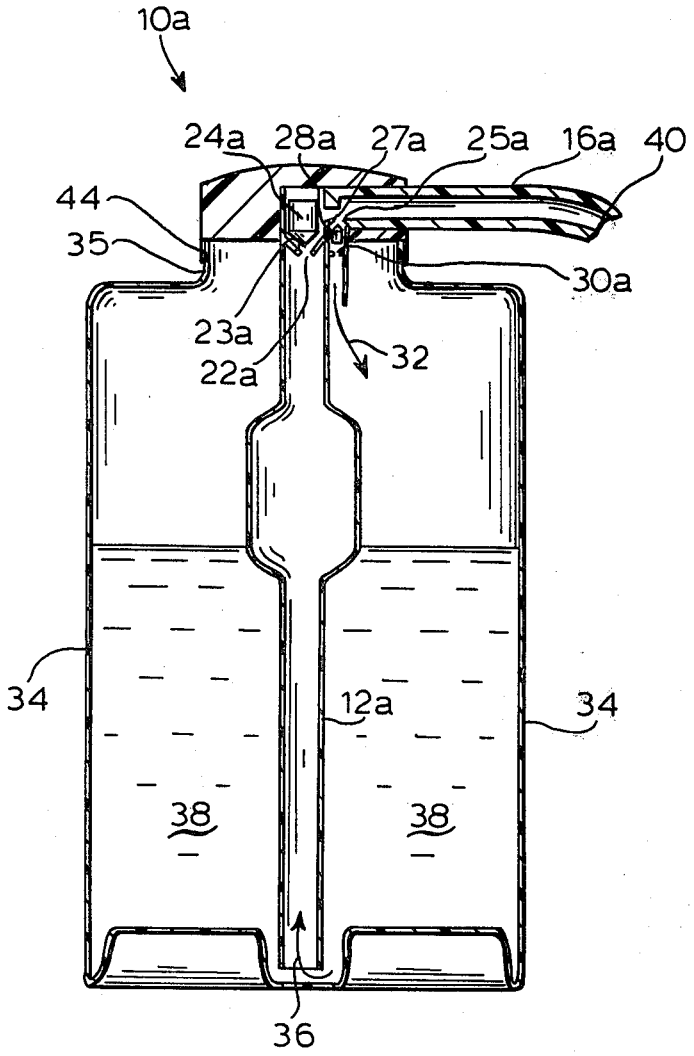
FIG. 2 is a cross-sectional view of a further embodiment of the closure of the invention applied to a squeeze-bottle typed container, and further illustrating a dispensing spout for dispensing the contents of the container.

Referring now to FIG. 2, a second embodiment of cap or closure of the invention is shown generally at **10*a*, and in this case applied to a flexible container 34 by being press-fit at 44 to the neck 35 of container 34. Opening 22*a* from feed tube 12*a* leading to delivery spout 16*a* under the control of valve 24*a*, which in this case is a weighted valve with a conical lower portion cooperating with a conically shaped seat 23*a*. The negative displacement check valve 28*a* is also conically shaped at the upper surface thereof with a cooperating conically shaped seat 25*a*. In this embodiment, delivery spout 16*a* ends in a downwardly extending tip 40 for dispensing the contents 38 of container 34**.

Thus, when the walls of container 34 are squeezed, the contents 38 thereof are forced in the direction of arrow 36 downwardly to the lower opening of feed tube 12 and upwardly to the opening **22*a*. The increased pressure applied to the liquid 38 causes or forces the weighted valve 24*a* upwardly allowing material to be dispensed through delivery spout 16*a*. Once pressure is removed from the walls of container 34, ambient pressure becomes higher than the pressure internally of container 34**.

This higher pressure in combination with the weight of weighted valve **24*a* causes that valve to seat against its seat 23*a* closing opening 22*a*. Simultaneously, this increased pressure in delivery spout 16*a* forces open valve 28*a* against its spring 30*a* causing any materials in 16*a* to move through the valve together with ambient air until such time as the pressure internally of container 34** and externally thereof are equalized. At this point, the structure is at rest until the next dispensing procedure.

Thus, as will be apparent from the foregoing, there is provided in accordance with this invention apparatus which functions to close flexible squeeze-type containers and to maintain a sealed environment automatically for the contents thereof until such time as a dispensing action is desired. Once a dispensing action is required, the squeezing action on the container causes a precise delivery of a quantity of material in a controlled manner wherein the container can be held and manipulated single-handedly by the user. Once the quantity of material to be dispensed has been dispensed, the arrangement of closure herein automatically operates to cut off any further delivery of material without any leaking or dripping, and to force back into the container any left over material in the delivery spout. In addition, the arrangement herein provides for the automatic sealing of the contents of the container once the dispensing action has been completed.

Nevertheless, the cap or closure of the invention here is of a simplified construction which may be easily and inexpensively produced by mass production techniques with a variety of popular materials, including thermoplastics. Moreover, the simplicity of the device herein makes it appropriate for use wherein specialized materials may be required, such as metal alloys which may be necessary for the handling of certain materials in the containers involved, as will be appreciated by practitioners in the art.

While the arrangements of apparatus herein described constitute preferred embodiments of this invention, it is to be understood that the invention is not limited to these precise arrangements of apparatus, and that changes may be made therein without departing from the scope of the invention which is defined in the appended claims.

What is claimed is:

1. A dispensing cap for dispensing materials contained in containers having flexible walls, comprising
(a) a cap body;
(b) an outlet passage in said body;
(c) a feed tube in flow communication with said outlet passage for extending into a container connected to said body for engaging material therein;
(d) container connection means on said body;
(e) a return tube in flow communication with said outlet passage;
the improvement characterized by
(f) first valve means in said outlet passage positioned between said feed tube and said outlet passage;
(g) first means biasing said first valve means against flow from said feed tube to said outlet passage;
(h) whereby squeezing the flexible walls of a container attached to said body forces material therein up said feed tube overcoming said first biasing means;
(i) second valve means in said outlet passage positioned between said outlet passage and said return tube; and
(j) second means biasing said second valve means against flow from said outlet passage to said return tube;
(k) whereby removing pressure from the flexible walls of a container attached to said body causes a reduction of pressure thereon so that ambient pressure forces open said second valve means against said second biasing means and closes said first valve means.

2. The apparatus of claim 1, further characterized by
(a) said first and second valve means are ball valves.

3. The apparatus of claim 2, further characterized by
(a) said first biasing means is a flexible flap engaging said first ball valve.

4. The apparatus of claim 1, further characterized by
(a) said first biasing means is a weight added to said first valve means.

5. The apparatus of claim 1, further characterized by said first valve means includes
(a) a valve body with at least a portion thereof conically shaped; and
(b) a conically shaped valve seat.

6. The apparatus of claim 5, further characterized by said second valve means includes
(a) a valve body with at least a portion thereof conically shaped; and
(b) a conically shaped valve seat.

7. The apparatus of claim 6, further characterized by
(a) said second biasing means is a spring.

8. The apparatus of claim 1, further characterized by
(a) said second biasing means is a spring.

9. The apparatus of claim 1, further characterized by
(a) a dispensing spout on said body in flow communication with said outlet passage.

10. The apparatus of claim 9, further characterized by
(a) said dispensing spout is integral with said body.

11. The apparatus of claim 1, further characterized by
(a) said body is comprised of a flexible material;
(b) first and second bores in said body in flow communication with said outlet passage; and
(c) said feed tube frictionally engaging said first bore, and said return tube frictionally engaging said second bore.

12. A dispenser for dispensing accurate quantities of materials contained therein comprising
(a) a container with flexible walls;
(b) a dispensing cap for engaging the opening of said container and having a cap body;
(c) an outlet passage in said cap body in flow communication with said container opening;
(d) cooperating means on said container and said cap body for connecting said cap to said container;
(e) a feed tube engaging said cap body and in flow communication with said outlet passage for extending into said container for engaging the said material therein;
(f) a return tube engaging said cap body and in flow communication with said outlet passage;
the improvement characterized by
(g) first valve means in said outlet passage positioned between said feed tube and said outlet passage;
(h) first means biasing said first valve means against flow from said feed tube to said outlet passage;
(i) second valve means in said outlet passage between said outlet passage and said return tube; and
(j) second means biasing said second valve means against flow from said outlet passage to said return tube;
(k) whereby moving said flexible walls of said container inwardly forces material therein up said feed tube overcoming said first biasing means, and releasing said flexible walls causes a reduction in pressure therein so that ambient pressure forces open said second valve means against said second biasing means and closes said first valve means for equalizing pressure internally and externally of said container.

13. The apparatus of claim 12, further characterized by
(a) said first and second valve means are ball valves.

14. The apparatus of claim 13, further characterized by
(a) said first biasing means is a flexible flap engaging said first ball valve.

15. The apparatus of claim 12, further characterized by
(a) said first biasing means is a weight added to said first valve means.

16. The apparatus of claim 12, further characterized by said first valve means includes
(a) a valve body with at least a portion thereof conically shaped; and
(b) a conically shaped valve seat.

17. The apparatus of claim 16, further characterized by said second valve means includes (a) a valve body with at least a portion thereof conically shaped; and (b) a conically shaped valve seat.

18. The apparatus of claim 17, further characterized by (a) said second biasing means is a spring.

19. The apparatus of claim 12, further characterized by (a) said second biasing means is a spring.

20. The apparatus of claim 12, further characterized by (a) a dispensing spout on said body in flow communication with said outlet passage.

21. The apparatus of claim 20, further characterized by (a) said dispensing spout is integral with said cap body.

22. The apparatus of claim 12, further characterized by (a) said body is comprised of a flexible material;

(b) first and second bores in said body in flow communication with said outlet passage; and (c) said feed tube frictionally engaging said first bore, and said return tube frictionally engaging said second bore.

* * * * *